US007871087B2

(12) United States Patent
Knapton

(10) Patent No.: US 7,871,087 B2
(45) Date of Patent: Jan. 18, 2011

(54) CORRUGATED HANGER FOR SKATEBOARD TRUCK

(76) Inventor: Michael Denver Knapton, 3391 N. 350 East, North Ogden, UT (US) 84414

( * ) Notice: Subject to any disclaimer, the term of this patent is extended or adjusted under 35 U.S.C. 154(b) by 385 days.

(21) Appl. No.: 12/008,561

(22) Filed: Jan. 11, 2008

(65) Prior Publication Data

US 2008/0169621 A1 Jul. 17, 2008

Related U.S. Application Data

(60) Provisional application No. 60/880,839, filed on Jan. 17, 2007.

(51) Int. Cl.
*A63C 17/01* (2006.01)

(52) U.S. Cl. ..... 280/11.27; 280/11.28; 280/87.042

(58) Field of Classification Search ..... 280/11.27, 280/11.28, 87.041, 87.042
See application file for complete search history.

(56) References Cited

U.S. PATENT DOCUMENTS 3,608,681 A * 9/1971 Schlor ..... 188/274
4,109,925 A * 8/1978 Williams et al. ..... 280/11.28
D252,693 S 8/1979 Brawner
D256,263 S 8/1980 Brawner
D257,051 S 9/1980 Chambers
D421,082 S 2/2000 Lopez
6,056,302 A 5/2000 Smith
6,460,868 B2 * 10/2002 Madrid ..... 280/87.042
D477,648 S 7/2003 Smith
6,648,345 B2 * 11/2003 Lee ..... 280/11.27
6,761,369 B1 7/2004 Anderson
7,581,739 B2 * 9/2009 Fraley ..... 280/87.041
2005/0236783 A1 * 10/2005 Reid ..... 280/11.27

* cited by examiner

*Primary Examiner*—J. Allen Shriver, II
*Assistant Examiner*—John R Olszewski
(74) *Attorney, Agent, or Firm*—Erik V Chmelar

(57) ABSTRACT

A hanger for a skateboard truck that generally comprises a ring-shaped member, a pivot stem, and an elongated barrel that houses an axle. Such elongated barrel defines a plurality of corrugations on the bottom thereof, the longitudinal axis of each corrugation aligned generally perpendicular to the longitudinal axis of such elongated barrel. Such corrugations are strategically distributed along such elongated barrel to ensure adequate engagement of some number of corrugations with such obstacle during a grind, helping to prevent such hanger from slipping off from such obstacle in a direction generally perpendicular to the general direction of intended grinding motion along such obstacle. Such hanger can be adapted to cooperate with a variety of existing skateboard truck baseplates.

11 Claims, 9 Drawing Sheets

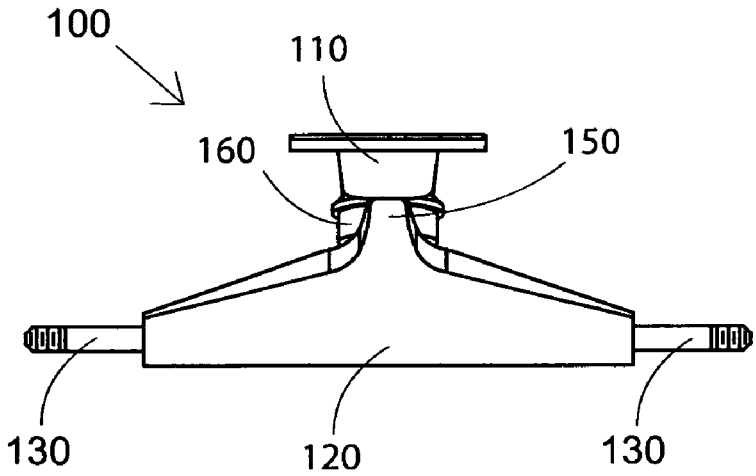
FIG. 2a (Prior Art)
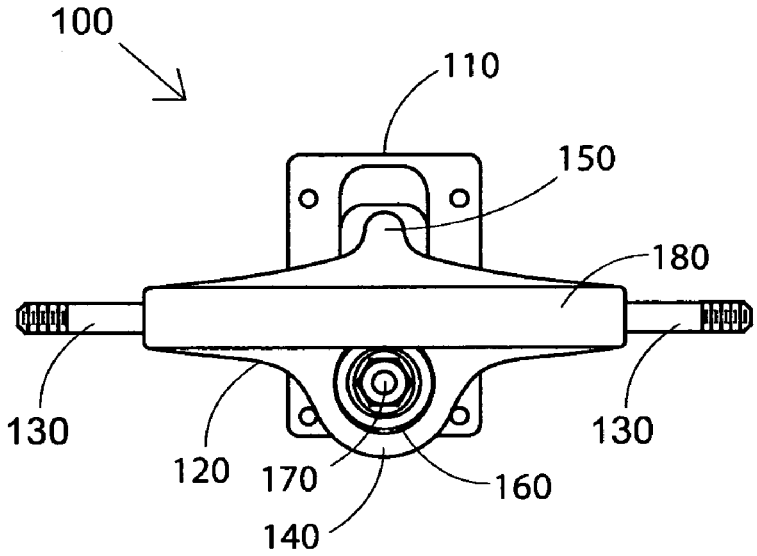
FIG. 2b (Prior Art)
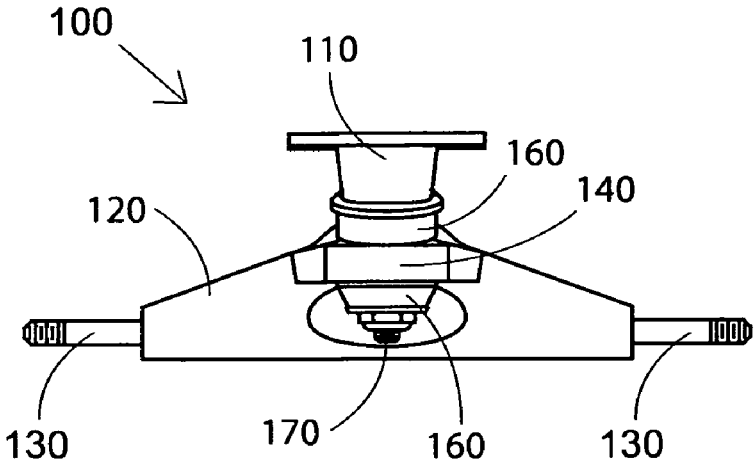
FIG. 2c (Prior Art)

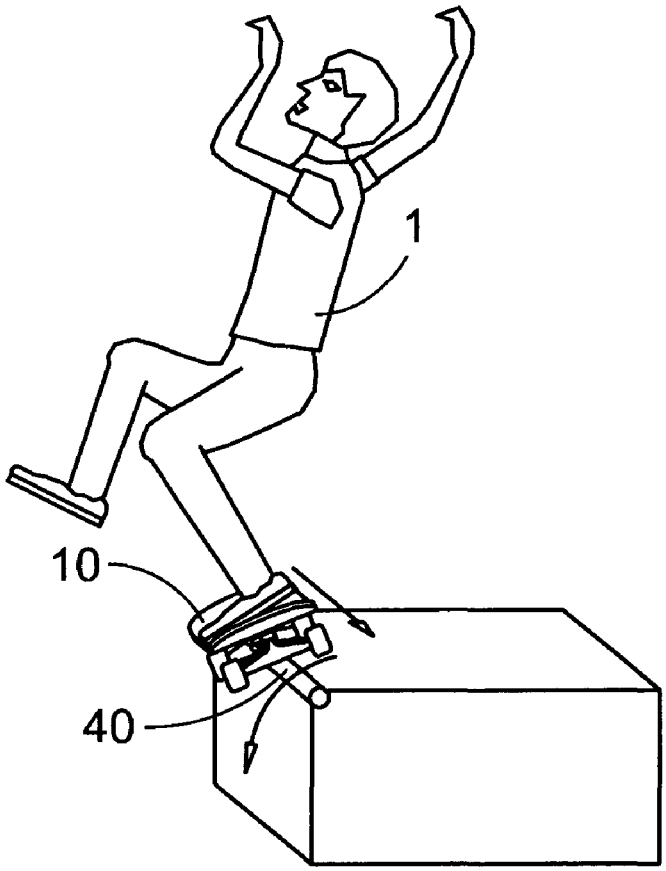
FIG. 3a (Prior Art)
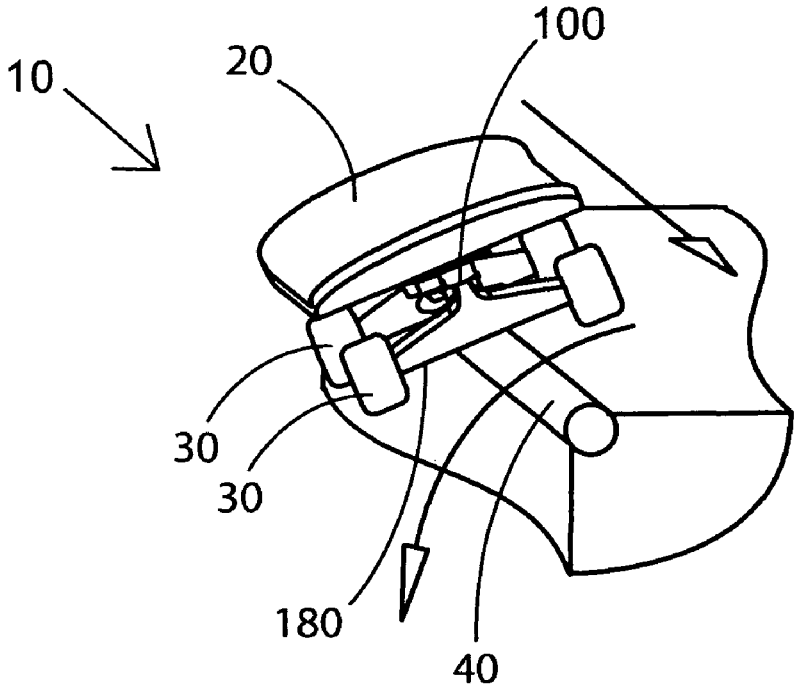
FIG. 3b (Prior Art)

CORRUGATED HANGER FOR SKATEBOARD TRUCK

This application claims the benefit of U.S. Provisional Patent Application No. 60/880,839, filed Jan. 17, 2007 by Michael Knapton.

BACKGROUND OF THE INVENTION

The present invention relates generally to an improved hanger of a skateboard truck of a skateboard, heretofore referred to as a truck, wherein such improved hanger helps stabilize such skateboard during certain tricks and maneuvers, specifically trucks stalls and grinds.

A skateboard generally comprises an elongated deck, two trucks, and four wheels. Two wheels are secured to opposite ends of an axle portion of each truck. Each truck is secured to opposite ends of the bottom surface of the deck. A skateboard is generally ridden with a skateboarder positioned on the top surface of the deck and the wheels contacting the ground or an obstacle, wherein the general direction of motion is parallel to the longitudinal axis of the deck.

A skateboarder may perform tricks and maneuvers while riding his or her skateboard. A truck stall is when the hanger of at least one truck is positioned in direct contact with an edge or apex of an obstacle, stalling the general motion of the skateboarder and skateboard. A grind is when the hanger of at least one truck is positioned in direct contact with an edge or apex of an obstacle but the skateboarder and skateboard continue their general direction of motion, literally grinding the hanger along the obstacle. Heretofore the term grind refers to either a grind or a truck stall.

The hanger of a truck generally comprises a ring-shaped member, a pivot stem, and an elongated barrel that houses an axle. During truck grinds, it is the bottom surface of the elongated barrel that contacts the edge or apex of the obstacle. This elongated barrel is generally cylindrical, flat along its longitudinal axis, and almost always smooth or polished to minimize friction during a grind. The elongated barrel of popular trucks manufactured during the 1970s was sometimes rectangular, generally much shorter than those of today, and sometimes included a logo or ornamentation impressed therein. However, as skateboard tricks and maneuvers progressed and grinding became popular, only smooth and flat elongated barrels remained practical.

Numerous trucks are described in the prior art, each describing various modifications or improvements thereof. A few prior art patents are listed below.

U.S. Pat. No. 7,150,460 (Williams), U.S. Pat. No. 6,547,262 (Yamada et. al.), and U.S. Pat. No. 6,182,987 (Bryant) teach trucks with improved turning responsiveness.

U.S. Pat. No. 7,093,842 (Chmelar) teaches a truck with wheel bite prevention.

U.S. Pat. No. 6,443,471 (Mullen) teaches a truck with a replaceable slide plate.

U.S. Pat. No. 6,474,666 (Andersen et. al.), U.S. Pat. No. 6,367,819 (Andersen et. al.), and U.S. Pat. No. 4,152,001 (Christianson) teach shock-absorbing trucks.

U.S. Pat. No. 7,243,925 (Lukoszek), U.S. Pat. No. 6,523,837 (Kirkland), and U.S. Pat. No. 6,315,304 (Kirkland et. al.) teach configurable trucks.

U.S. Pat. No. 5,971,411 (Jones et. al.), U.S. Pat. No. 4,398,734 (Barnard), and U.S. Pat. No. 4,184,693 (Whitmarsh) teach easily manufactured trucks.

U.S. Pat. No. D257,051 (Chambers) teaches a truck with a design impressed on the bottom surface of the elongated barrel.

U.S. Pat. No. 6,761,369 (Anderson) teaches a truck with a low-friction grinding ability.

The smooth and longitudinally flat elongated barrel of the above prior art trucks create a limitation that manifests during a grind attempt. When a skateboarder engages his or her skateboard onto an obstacle to attempt a grind, the elongated barrel contacting such obstacle may slip off from such obstacle in a direction generally perpendicular to the general direction of intended grinding motion along such obstacle, resulting in a failed grind attempt. The improved hanger of the present invention, which can be adapted to cooperate with a variety of existing skateboard truck baseplates, defines a plurality of corrugations on the bottom of the elongated barrel, each generally perpendicular to the longitudinal axis thereof. Such corrugations help to prevent such elongated barrel from slipping off from an obstacle when in contact therewith, thereby increasing the stability of the skateboard during a grind.

U.S. Pat. No. D477,648 (Smith), U.S. Pat. No. 6,056,302 (Smith), and U.S. Pat. No. D421,082 (Lopez) also teach trucks that result in increased stability during a grind; however, the mechanism taught or shown thereby is a large and generally smooth channel formed at the medial portion of the bottom surface of the elongated barrel. Such a channel operates to partially encompass an edge or apex of an obstacle during a grind, as is typically formed to cooperate best with the standard two-inch diameter round pipe found on most skateboard ramps and obstacles. In contrast, each individual corrugation of the present invention is significantly smaller than such channel. Furthermore, such corrugations are strategically distributed along the bottom of the elongated barrel to ensure adequate engagement of some number of corrugations with an obstacle during a grind, regardless of the general shape of the edge or apex of such obstacle.

U.S. Pat. No. D256,263 (Brawner), U.S. Pat. No. D252,693 (Brawner), and U.S. Pat. No. 4,109,925 (Williams, et. al.) teach trucks that include a pair of ornamental ribs at each distal end of the elongated barrel. Such distal location of such ornamental pairs of ribs makes engagement with an edge or apex of most obstacles therewith during a grind attempt impossible. For example, such ornamental distal pairs of ribs could not engage a standard two-inch diameter round pipe that is found on most skateboard ramps and rails. In contrast, the corrugations of the present invention, which are strategically distributed along the bottom of the elongated barrel, ensure adequate engagement of some number of corrugations with such obstacle during a grind. Accordingly, the quantity of individual corrugations defined on the elongated barrel of the present invention is greater than the quantity of such individual ornamental distal ribs defined on such elongated barrels of such prior art trucks.

Accordingly, what is desired, and has not heretofore been developed, is a skateboard truck hanger that defines a plurality of corrugations strategically distributed along the bottom of the elongated barrel of such hanger, capable of engaging an edge or apex of an arbitrary obstacle during a grind, thereby helping to prevent such elongated barrel from slipping off from such obstacle in a direction generally perpendicular to the general direction of intended grinding motion along such obstacle. In a further feature of the present invention, the corrugations of the hanger protract upwards on a front portion of the elongated barrel at a specified angle towards the pivot stem of the hanger.

BRIEF SUMMARY OF THE INVENTION

It is an object of the present invention to provide a hanger of a skateboard truck that defines on the bottom of its elongated barrel a plurality of corrugations.

It is an object of the present invention that the longitudinal axes of such corrugations is aligned generally perpendicular to the longitudinal axis of such elongated barrel.

It is an object of the present invention that such corrugations are strategically distributed along such elongated barrel to ensure adequate engagement of some number of such corrugations with an arbitrary obstacle during a grind.

It is an object of the present invention that such corrugations are formed by any means, for example cast in place or machined.

It is an object of the present invention that such corrugations may be formed by adding material to an elongated barrel (additive process), by subtracting material from an elongated barrel (subtractive process), or by both adding and subtracting material from an elongated barrel (combined additive and subtractive process).

It is a further object of the present invention to provide a hanger of a skateboard truck that defines on the bottom of its elongated barrel a plurality of corrugations that protract upwards on a front portion of such elongated barrel.

It is a further object of the present invention that such protracted corrugations defined on a front portion of such elongated barrel protract upwards at an arbitrary angle towards the pivot stem of the hanger.

It is an object of the present invention that any such corrugated hanger can be adapted to cooperate with a variety of existing skateboard truck baseplates to form a functional skateboard truck.

BRIEF DESCRIPTION OF THE DRAWINGS

FIG. 2*a*, FIG. 2*b*, and FIG. 2*c* are front, bottom, and back views of a typical skateboard truck, respectively.

FIG. 3*a* is a perspective view of a skateboarder slipping off from an obstacle during a grind attempt, and FIG. 3*b* is a perspective view of only the skateboard of FIG. 3*a*.

DETAILED DESCRIPTION OF THE INVENTION

Figure 1:
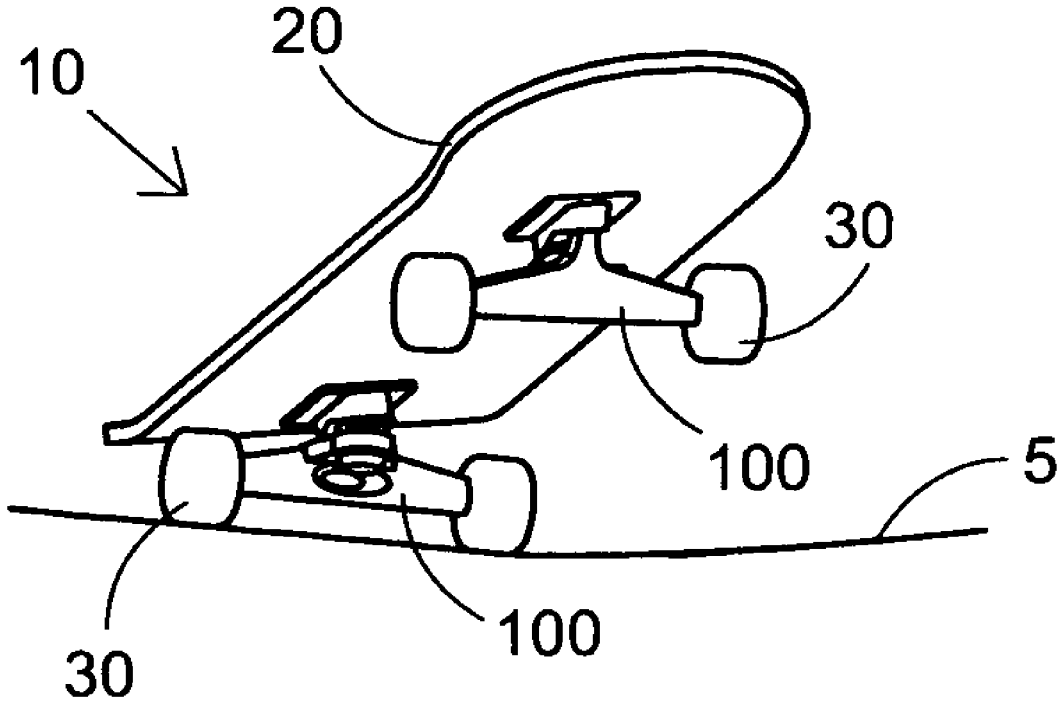
FIG. 1 (Prior Art)
FIG. 1 is a perspective view of a typical skateboard.

FIG. 1 shows a typical skateboard 10 contacting a surface 5, including a deck 20, four wheels 30, and two trucks 100. FIG. 2*a*, FIG. 2*b*, and FIG. 2*c* show more detailed views of a truck 100, generally comprising a baseplate 110 and a hanger 120, joined together by means of a bolt called a kingpin 170. The kingpin 170 extends downwardly from the baseplate 110, through a pair of bushings 160, and through the ring-shaped member 140 of the hanger 120. The bushings 160 sandwich the ring-shaped member 140 and provide an elestomeric response when the hanger 120 pivots during a turn. The kingpin 170 typically has a threaded portion on the lowermost distal end for communication with a bolt that secures the bushings 160 and ring-shaped member 140 in place; however, the kingpin 170 may be inverted with its threaded portion within the baseplate 110 and its head on the lowermost distal end.

The hanger 120 includes an axle 130 to secure wheels 30 thereto. The axle 130 is contained within an elongated barrel 180, which is the lowermost portion of the hanger 120. Although the elongated barrel 180 is shown longitudinally flat, it may be shaped as any prior art hanger, for example it may include a channel at its median; the corrugations of the present invention may be used with any such hanger, not simply a longitudinally flat hanger. A pivot stem 150 extends upwards from the median of the elongated barrel 180 to communicate with a frontal portion of the baseplate 110. The baseplate 110 attaches to the deck 20.

FIG. 3*a* shows a skateboarder 1 slipping off from an obstacle 40 while attempting a grind. FIG. 3*b* shows a more detailed view of only the skateboard 10 of FIG. 3*a*. The elongated barrel 180 of the truck 100 is in direct contact with the obstacle 40 during a grind. Because the elongated barrel 180 is smooth and flat along its longitudinal axis, it is very easy for the elongated barrel 180 to slip off from the obstacle 40, causing the skateboarder 1 to fall. Furthermore, because the wheels 30 extend downward below the elongated barrel 180, if the wheels 30 contact the obstacle 40 during the grind attempt, the elongated barrel 180 is tilted at some angle with respect to a stable horizontal position, increasing the tendency of the elongated barrel 180 to slip off from the obstacle 40.

Figure 4A:
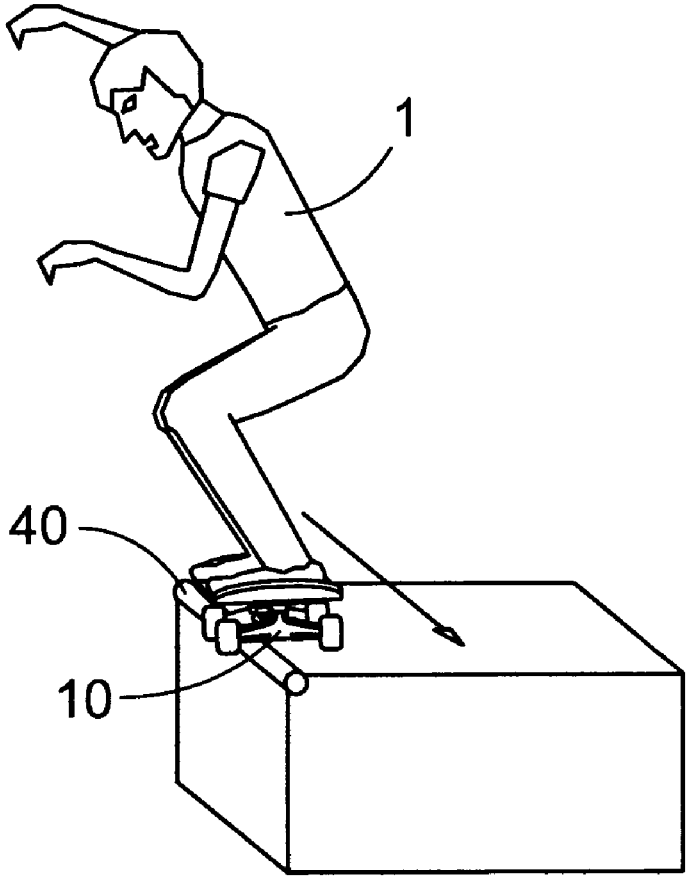
FIG. 4*a* is a perspective view of a skateboarder not slipping off from an obstacle during a grind.
Figure 4B:
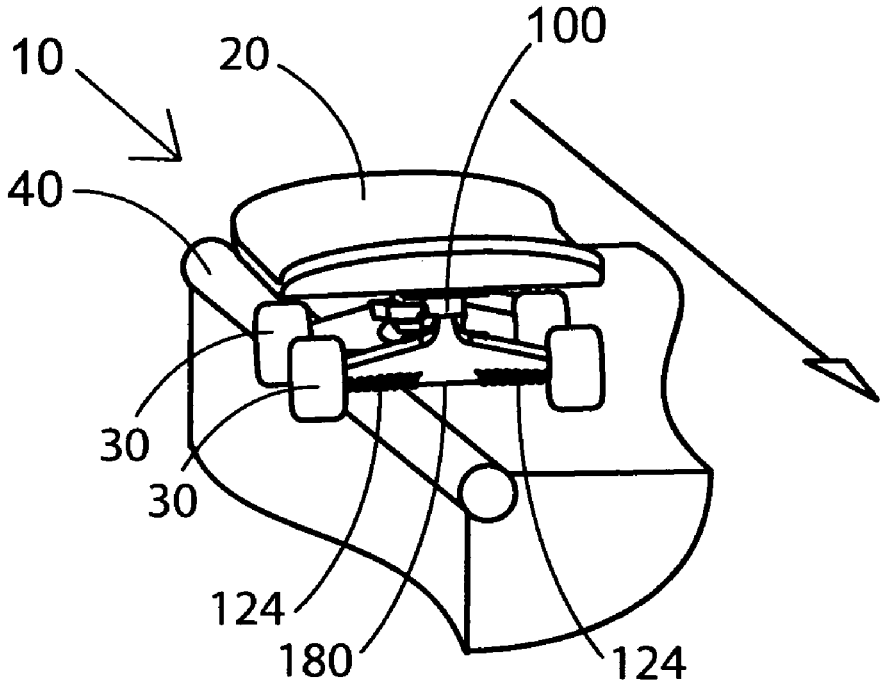
FIG. 4*b* is a perspective view of only the skateboard of FIG. 4*a*.

FIG. 4*a* shows a skateboarder 1 successfully grinding an obstacle 40. FIG. 4*b* shows a more detailed view of only the skateboard 10 of FIG. 4*a*. The corrugations 124 defined on the bottom of the elongated barrel 180 communicate with the obstacle 40, preventing the elongated barrel 180 from slipping off from the obstacle 40.

FIG. 5*a*, FIG. 5*b*, FIG. 5*c*, and FIG. 5*d* show front, bottom, back, and side views of a first embodiment of the hanger 120 of the present invention. A pivot stem 150 extends upwardly and forwardly from the median of the hanger 120 and a ring-shaped member 140 extends backwardly from the median of the hanger 120. The lowermost portion of the hanger 120 defines an elongated barrel 180, within which is housed an axle 130. Two regions of corrugations 124 are defined on the bottom of the elongated barrel 180, near the distal ends thereof. The longitudinal axis of each corrugation 124 is perpendicular to the longitudinal axis of the elongated barrel 180.

Although the regions of corrugations 124 are shown extending to the very distal ends of the elongated barrel 180, such need not be the case; there may be a region lacking corrugations on each distal end thereof. Furthermore, although not illustrated, alternate truck hanger anatomies, such as those of typical longboard, slalom, or racing trucks, in which both the pivot stem 150 and ring-shaped member 140 extend forwardly from the median of the elongated barrel 180, are also within the scope of the present invention.

The minimal length of each region of corrugations 124, defined as the length of such corrugations 124 along the longitudinal axis of the elongated barrel 180, is sufficient to ensure at least some portion of corrugations 124 will communicate with an obstacle 40 of arbitrary shape during a grind, for example the edge of a curb or a two-inch diameter metal pipe. For grinding a two-inch diameter pipe, such minimal length may be defined to be approximately one inch.

The corrugations 124 may be formed on the elongated barrel 180 by an additive process wherein material is added to the elongated barrel 180 to form the corrugations 124, by a subtractive process wherein material is removed from the elongated barrel 180 to form the corrugations 124, or by a combined additive and subtractive process wherein material is both added and subtracted from the elongated barrel 180 to form the corrugations 124. The elevation of a corrugation 124 is heretofore used to refer to the portion thereof that extends outwardly from the axle 130 of the elongated barrel 180. The depression of a corrugation 124 is heretofore used to refer to the portion thereof that extends inwardly towards the axle 130 of elongated barrel 180. In the additive process, the elevations extend beyond the periphery of the elongated barrel 180 and the depressions neither extend beyond nor within the periphery of the elongated barrel 180. In the subtractive process, the depressions extend within the periphery of the elongated barrel 180 and the elevations neither extend beyond nor within the periphery of the elongated barrel 180. Finally, in the additive and subtractive process, the elevations extend beyond the periphery of the elongated barrel 180 and the depressions extend within the periphery of the elongated barrel 180. Any particular formation of corrugations 124 of any embodiment of the present invention is shown for illustrative purposes only and is not intended to restrict any particular embodiment to a particular type of formation of corrugations 124. For example, FIG. 5*a*, FIG. 5*b*, FIG. 5*c*, and FIG. 5*d* show corrugations 124 formed by a combined additive and subtractive process, in contrast to FIG. 7*a*, FIG. 7*b*, FIG. 7*c*, and FIG. 7*d* which show essentially the same hanger 120 but with corrugations 124 formed by a subtractive process. Furthermore, on a given hanger 120, individual corrugations 124 may be formed by different processes, for example corrugations 124 at the distal ends formed by an additive process while corrugations 124 at the median formed by a subtractive process.

Figure 5A:
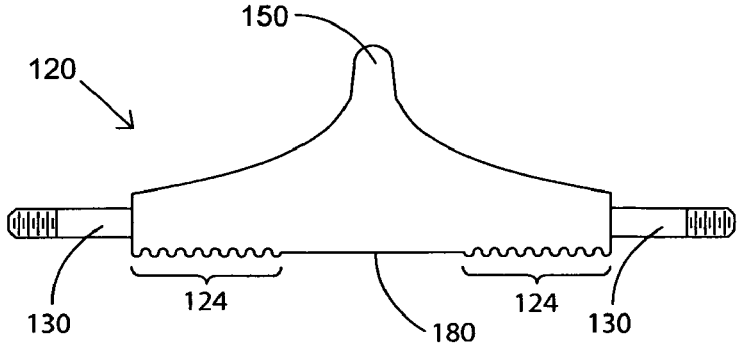
FIG. 5*a*, FIG. 5*b*, FIG. 5*c*, and FIG. 5*d* are front, bottom, back, and side views of a first embodiment of the hanger of the present invention, respectively.
Figure 5B:
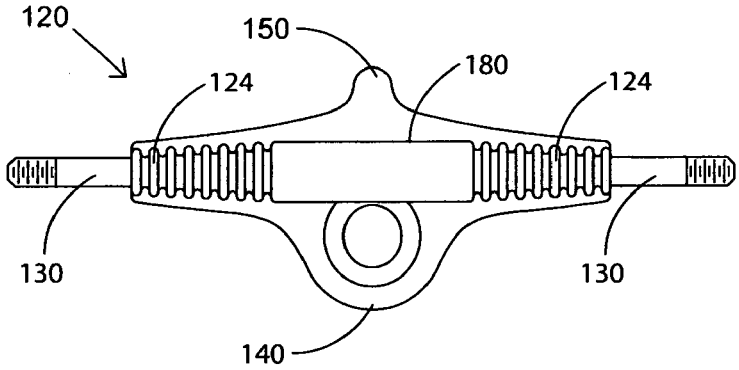
Figure 5C:
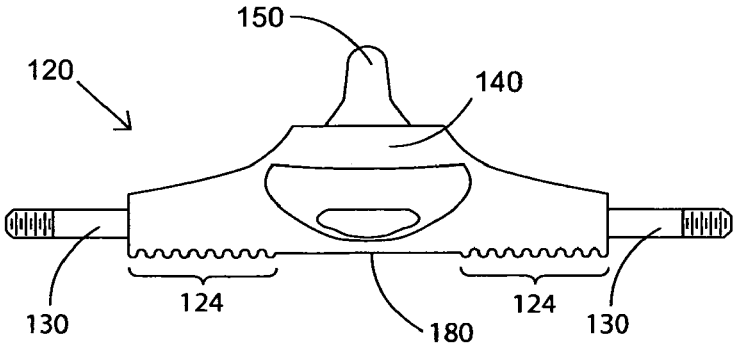
Figure 5D:
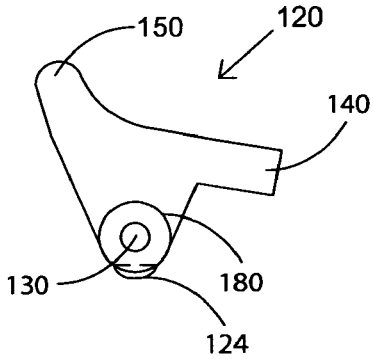
Figure 6A:
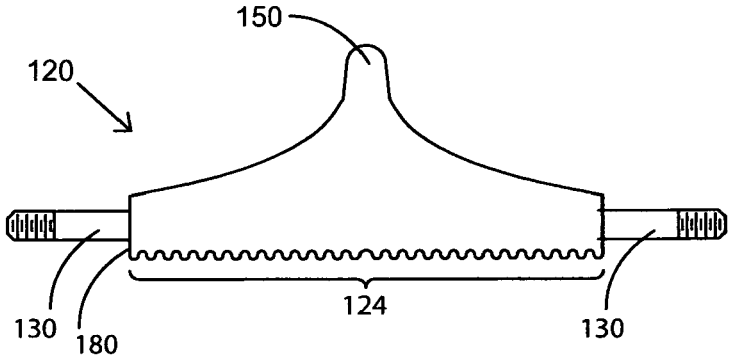
FIG. 6*a*, FIG. 6*b*, FIG. 6*c*, and FIG. 6*d* are front, bottom, back, and side views of a second embodiment of the hanger of the present invention, respectively.
Figure 6B:
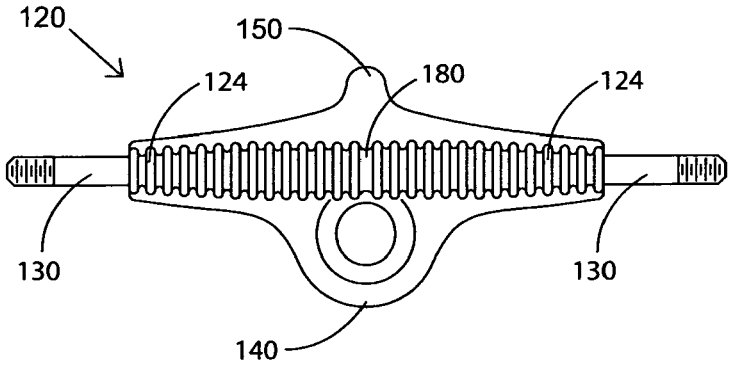
Figure 6C:
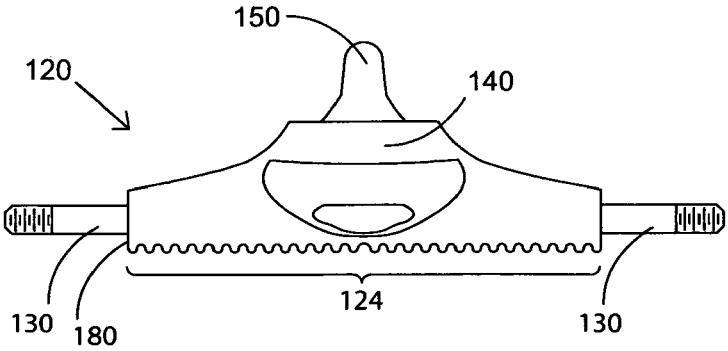
Figure 6D:
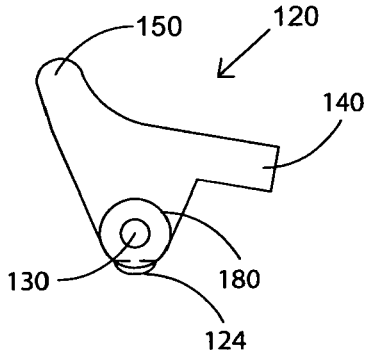
Figure 7A:
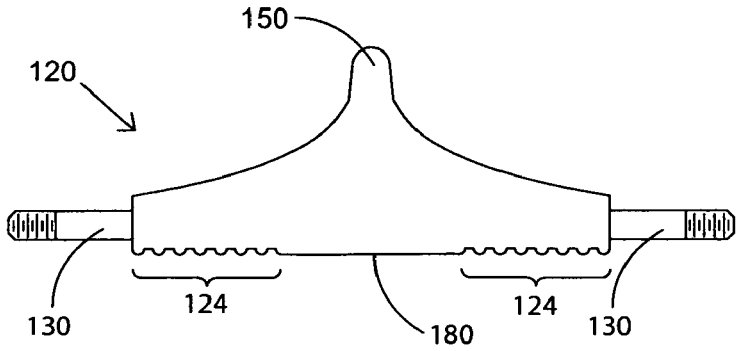
FIG. 7*a*, FIG. 7*b*, FIG. 7*c*, and FIG. 7*d* are front, bottom, back, and side views of a third embodiment of the hanger of the present invention, respectively.
Figure 7B:
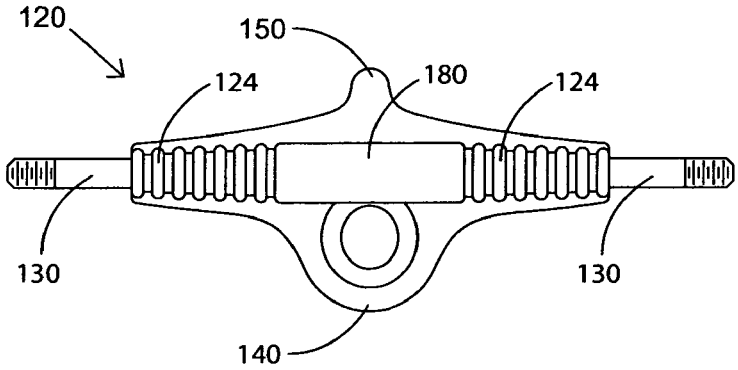
Figure 7C:
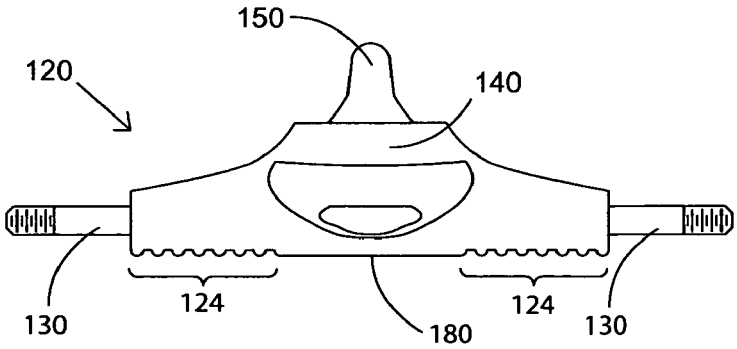
Figure 7D:
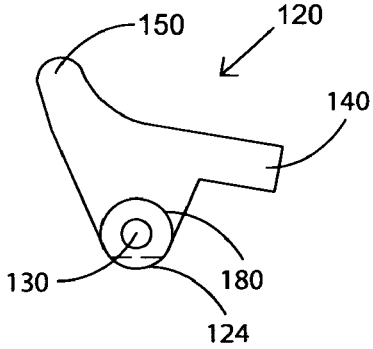

The elevation and depression profile of any individual corrugation 124, as seen in the front views (FIG. 5*a*, FIG. 6*a*, FIG. 7*a*, FIG. 8*a*, and FIG. 9*a*) and back views (FIG. 5*c*, FIG. 6*c*, FIG. 7*c*, FIG. 8*c*, and FIG. 9*c*), may define any arbitrary profile, for example sinusoidal, square, triangular, or any combination thereof. Any particular corrugation 124 profile of any embodiment of the present invention is shown for illustrative purposes only and is not intended to restrict any particular embodiment to a particular type of corrugation 124 profile. For example, FIG. 5*a* and FIG. 5*c* show a corrugation 124 profile that appears sinusoidal (convex elevations and concave depressions), in contrast to FIG. 7*a* and FIG. 7*c* which show a corrugation 124 profile that appears to have convex elevations and flat depressions.

FIG. 6*a*, FIG. 6*b*, FIG. 6*c*, and FIG. 6*d* show front, bottom, back, and side views of a second embodiment of the hanger 120 of the present invention. Here only a single region of corrugation 124 is defined, encompassing the entire length of the bottom of the elongated barrel 180. Although the region of corrugation 124 is shown extending to the very distal ends of the elongated barrel 180, such need not be the case; there may be a region lacking corrugations on each distal end thereof.

Although not illustrated, more than one or two regions of corrugations 124 may be defined on the bottom of the elongated barrel 180, for example three regions or four regions.

FIG. 8*a*, FIG. 8*b*, FIG. 8*c*, and FIG. 8*d* show front, bottom, back, and side views of a fourth embodiment of the hanger 120 of the present invention. The corrugations 124 are defined on the bottom of the elongated barrel 180 and protract upwards on a front portion thereof at a specified angle towards the pivot stem 150. Such forwardly protracted corrugations 124 aid in stabilizing the elongated barrel 180 during special special grind maneuvers wherein the deck 20 is tilted to cause only one elongated barrel 180 to directly contact the obstacle 40 (nose-grind, k-grind, 5-0 grind, etc.). During such special grinds, the longitudinal axis of the skateboard 10 is often times not aligned in the general direction of grinding motion, but is skewed to one side. The protraction of the corrugations 124 on the front portion of the elongated barrel 180 may be angled to correspond to such possible skew in the longitudinal axis of the skateboard 10 relative to the obstacle 40 during such a grind. Such angle of protraction of corrugation 124 is defined by the angle between a reference line drawn longitudinally along the bottom of the elongated barrel 180 and a reference line drawn longitudinally along the direction of protraction of the corrugation 124. For example, a corrugation 124 that protracts vertically upwards defines a 90 degree angle with respect to the reference line drawn longitudinally along the bottom of the elongated barrel 180.

Figure 8A:
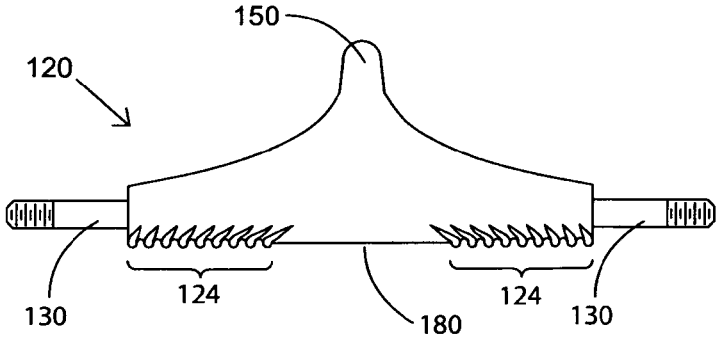
FIG. 8*a*, FIG. 8*b*, FIG. 8*c*, and FIG. 8*d* are front, bottom, back, and side views of a fourth embodiment of the hanger of the present invention, respectively.
Figure 8B:
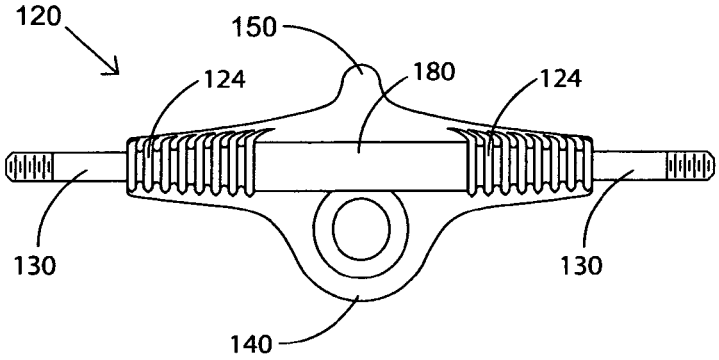
Figure 8C:
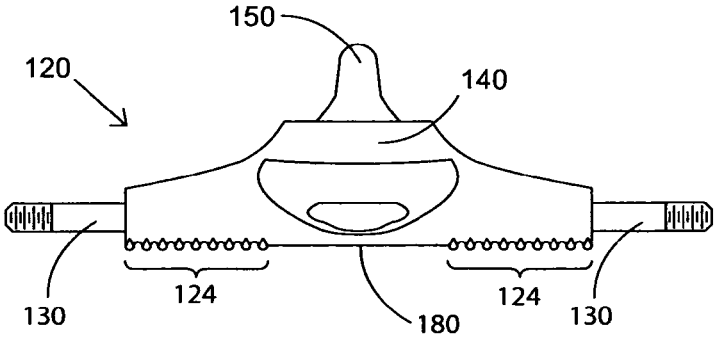
Figure 8D:
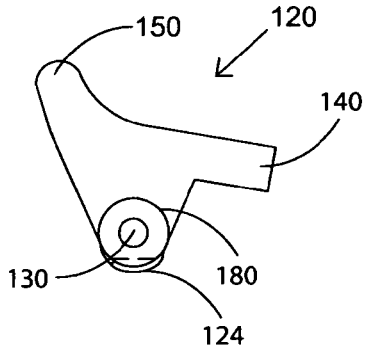
Figure 9A:
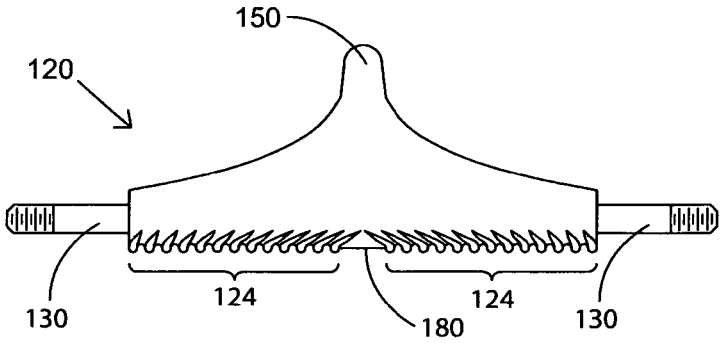
FIG. 9*a*, FIG. 9*b*, FIG. 9*c*, and FIG. 9*d* are front, bottom, back, and side views of a fifth embodiment of the hanger of the present invention, respectively.
Figure 9B:
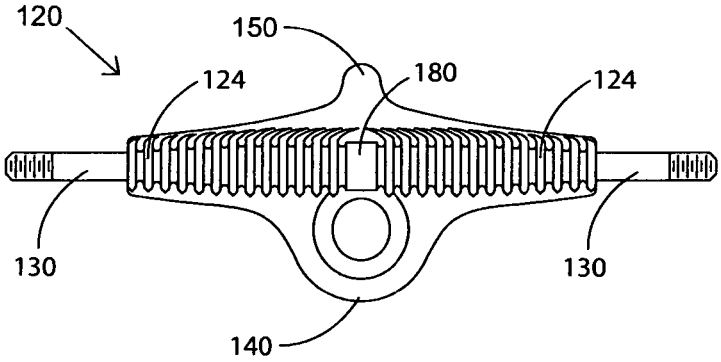
Figure 9C:
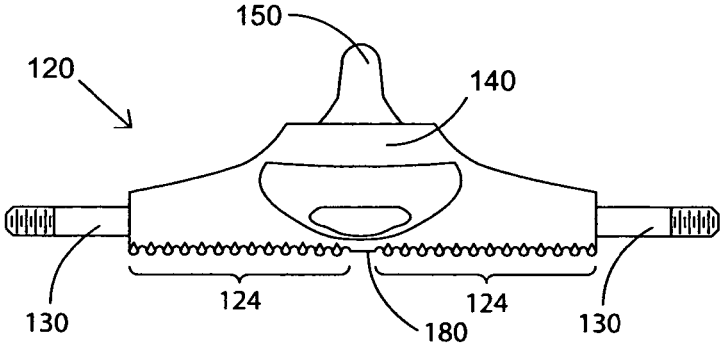
Figure 9D:
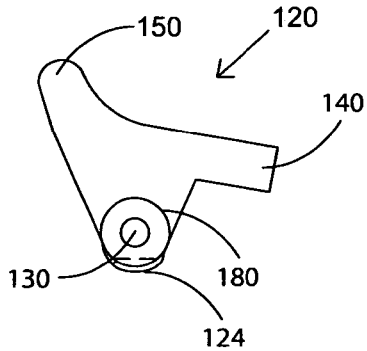

In the preferred embodiment of such upwardly protracted corrugations 124, those located at the very distal ends of the elongated barrel 180 protract at a large angle and those near the median of the elongated barrel 180 protract at a smaller angle, as shown in FIG. 8*a*. Although not illustrated, the protractions of the corrugations 124 could define no angle, all the same angle, or arbitrary angles with respect to a line extending from the median of the elongated barrel 180 upwards through the median of the distal end of the pivot stem 150. Any particular angle of protraction of corrugations 124 of any embodiment of the present invention is shown for illustrative purposes only and is not intended to restrict any particular embodiment to a particular angle of protraction of corrugations 124. Furthermore, although not illustrated, not every corrugation 124 must be protracted upwardly and forwardly. For example, it may be beneficial that only a few corrugations 124, or every other corrugation 124 include an upward and forward protraction. The correspondence of each corrugation 124 protracting upwardly and forwardly of any embodiment of the present invention is shown for illustrative purposes only and is not intended to restrict any particular embodiment to a particular correspondence of corrugations 124 that protract upwardly and forwardly.

FIG. 9*a*, FIG. 9*b*, FIG. 9*c*, and FIG. 9*d* show front, bottom, back, and side views of a fourth embodiment of the hanger 120 of the present invention. Here only a single region of corrugation 124 and associated upward protractions is defined, encompassing the entire length of the bottom and forward portion of the elongated barrel 180. Although the region of corrugation 124 is shown extending to the very distal ends of the elongated barrel 180, such need not be the case; there may be a region lacking corrugations on each distal end thereof.

What is claimed is:

1. A hanger for a skateboard truck comprising:

an axle;

an elongated barrel housing said axle, said elongated barrel defining along a bottom portion thereof a plurality of corrugations whose longitudinal axes are aligned generally perpendicular to the longitudinal axis of said elongated barrel, at least one of said corrugations protracting upwardly and forwardly along a front portion of said elongated barrel at a non-perpendicular angle with respect to a reference line drawn longitudinally along the bottom of said elongated barrel;

a ring-shaped member extending from the median of said elongated barrel; and a pivot stem extending from the median of said elongated barrel.

2. The hanger of claim 1 wherein at least one of said upwardly and forwardly protracted corrugations located near a distal end of said elongated barrel protracts at a different angle than at least one of said upwardly and forwardly protracted corrugations located near the median of said elongated barrel with respect to a reference line drawn longitudinally along the bottom of said elongated barrel.

3. The hanger of claim 1 wherein at least one of said upwardly and forwardly protracted corrugations located near a distal end of said elongated barrel protracts at a larger angle than at least one of said upwardly and forwardly protracted corrugations located near the median of said elongated barrel with respect to a reference line drawn longitudinally along the bottom of said elongated barrel.

4. The hanger of claim 1 wherein said corrugations are confined within two individual regions along said bottom portion of said elongated barrel, one region of corrugations near each distal end of said elongated barrel.

5. The hanger of claim 1 wherein said corrugations are confined within a single contiguous region along said bottom portion of said elongated barrel, extending the entire length of said elongated barrel.

6. A hanger for a skateboard truck comprising:

an axle;

an elongated barrel housing said axle, said elongated barrel defining along a bottom portion thereof a plurality of corrugations whose longitudinal axes are aligned generally perpendicular to the longitudinal axis of said elongated barrel, at least one of said corrugations located near a distal end of said elongated barrel protracting upwardly and forwardly along a front portion of said elongated barrel, at least one of said corrugations near the median of said elongated barrel protracting upwardly and forwardly along a front portion of said elongated barrel, said distally located corrugation protracting at a different angle than said medially located corrugation with respect to a reference line drawn longitudinally along the bottom of said elongated barrel;

a ring-shaped member extending from the median of said elongated barrel; and a pivot stem extending from the median of said elongated barrel.

7. The hanger of claim 6 wherein said corrugations are confined within two individual regions along said bottom portion of said elongated barrel, one region of corrugations near each distal end of said elongated barrel.

8. The hanger of claim 6 wherein said corrugations are confined within a single contiguous region along said bottom portion of said elongated barrel, extending the entire length of said elongated barrel.

9. A hanger for a skateboard truck comprising:

an axle;

an elongated barrel housing said axle, said elongated barrel defining along a bottom portion thereof a plurality of corrugations whose longitudinal axes are aligned generally perpendicular to the longitudinal axis of said elongated barrel, at least one of said corrugations located near a distal end of said elongated barrel protracting upwardly and forwardly along a front portion of said elongated barrel, at least one of said corrugations near the median of said elongated barrel protracting upwardly and forwardly along a front portion of said elongated barrel, said distally located corrugation protracting at a larger angle than said medially located corrugation with respect to a reference line drawn longitudinally along the bottom of said elongated barrel;

a ring-shaped member extending from the median of said elongated barrel; and a pivot stem extending from the median of said elongated barrel.

10. The hanger of claim 9 wherein said corrugations are confined within two individual regions along said bottom portion of said elongated barrel, one region of corrugations near each distal end of said elongated barrel.

11. The hanger of claim 9 wherein said corrugations are confined within a single contiguous region along said bottom portion of said elongated barrel, extending the entire length of said elongated barrel.

* * * * *